US012736256B2

(12) United States Patent
Olfe et al.

(10) Patent No.: US 12,736,256 B2
(45) Date of Patent: Sep. 15, 2026

(54) HEAT PUMP, METHOD FOR OPERATING A HEAT PUMP, AND TRANSPORTATION VEHICLE WITH A HEAT PUMP

(71) Applicant: VOLKSWAGEN AKTIENGESELLSCHAFT, Wolfsburg (DE)

(72) Inventors: Jürgen Olfe, Volkse (DE); Christian Schneck, Braunschweig (DE)

(73) Assignee: VOLKSWAGEN AKTIENGESELLSCHAFT (DE)

( * ) Notice: Subject to any disclaimer, the term of this patent is extended or adjusted under 35 U.S.C. 154(b) by 169 days.

(21) Appl. No.: 18/661,980

(22) Filed: May 13, 2024

(65) Prior Publication Data

US 2024/0384900 A1 Nov. 21, 2024

(30) Foreign Application Priority Data

May 16, 2023 (DE) ..... 10 2023 204 582.6

(51) Int. Cl.
*F25B 30/02* (2006.01)
*F25B 7/00* (2006.01)
*F25B 43/00* (2006.01)

(52) U.S. Cl.
CPC ..... *F25B 30/02* (2013.01); *F25B 7/00* (2013.01); *F25B 43/006* (2013.01); *F25B 2313/001* (2013.01)

(58) Field of Classification Search
CPC .... F25B 2313/001; F25B 23/00; F25B 30/02; F25B 7/00; B60H 1/00007
See application file for complete search history.

(56) References Cited

U.S. PATENT DOCUMENTS

| | | | | |
|---|---|---|---|---|
| 4,642,994 | A * | 2/1987 | Barclay | F25B 21/00 62/3.3 |
| 9,599,374 | B2 * | 3/2017 | Takahashi | F25B 21/00 |
| 10,006,675 | B2 * | 6/2018 | Benedict | F25D 17/02 |
| 10,684,044 | B2 * | 6/2020 | Schroeder | F25B 21/00 |
| 2005/0022538 | A1 | 2/2005 | Takagi | |

(Continued)

FOREIGN PATENT DOCUMENTS

| | | | |
|---|---|---|---|
| DE | 3044684 | A1 | 7/1982 |
| DE | 4438427 | A1 | 5/1996 |

(Continued)

*Primary Examiner* — Nelson J Nieves
(74) *Attorney, Agent, or Firm* — BARNES & THORNBURG LLP

(57) ABSTRACT

A heat pump in which an increased temperature rise is achieved, including heat accumulators behind one another in a cascade; caloric accumulator elements positioned alternatingly in thermally conducting contact with one of the heat accumulators; and at least one drive method or mechanism for changing the position of the accumulator elements between the heat accumulators, at least one of the heat accumulators is in contact with a component to control the temperature of this component, a last one of the heat accumulators in the cascade is in heat exchange with surroundings. An intermediate accumulator is formed from at least one of the heat accumulators for transmitting heat between a heat accumulator in contact with a component to be temperature-controlled and the last heat accumulator.

16 Claims, 4 Drawing Sheets

(56) References Cited

U.S. PATENT DOCUMENTS

| | | | | |
|---|---|---|---|---|
| 2014/0290273 | A1 | 10/2014 | Benedict et al. | |
| 2015/0369524 | A1 | 12/2015 | Ikegami et al. | |
| 2017/0130999 | A1* | 5/2017 | Numazawa | F25B 21/00 |
| 2018/0045437 | A1* | 2/2018 | Vetrovec | F25B 21/00 |
| 2020/0049389 | A1* | 2/2020 | Wuest | F25B 23/00 |
| 2020/0217567 | A1* | 7/2020 | Schroeder | F25B 23/00 |
| 2024/0424853 | A1* | 12/2024 | Schneck | B60H 1/00007 |

FOREIGN PATENT DOCUMENTS

| | | | |
|---|---|---|---|
| DE | 102010000647 | A1 | 9/2011 |
| DE | 202015103017 | U1 | 2/2016 |
| DE | 102018200376 | A1 | 7/2019 |
| DE | 102018207577 | A1 | 11/2019 |
| DE | 102019203889 | A1 | 9/2020 |
| EP | 2650622 | A1 | 10/2013 |
| WO | 0163186 | A1 | 8/2001 |

* cited by examiner

HEAT PUMP, METHOD FOR OPERATING A HEAT PUMP, AND TRANSPORTATION VEHICLE WITH A HEAT PUMP

PRIORITY CLAIM

This patent application claims priority to German Patent Application No. 10 2023 204 582.6, filed 16 May 2023, the disclosure of which is incorporated herein by reference in its entirety.

SUMMARY

Illustrative embodiments relate to a heat pump, to a method for operating a heat pump of this type, and to a transportation vehicle with a heat pump of this type.

Illustrative embodiments relate to a heat pump that includes a plurality of heat accumulators which are arranged behind one another in a cascade, a plurality of caloric accumulator elements positioned in an alternating manner relative to each one of the heat accumulators, and at least one drive method or mechanism for changing the position of the accumulator elements between the heat accumulators, wherein at least one of the heat accumulators is in contact with a component to control the temperature of this component, and wherein a last one of the heat accumulators in the cascade being in heat exchange with surroundings.

BRIEF DESCRIPTION OF THE DRAWINGS

Exemplary embodiments will be explained in greater detail in the following text on the basis of the drawings, in which.

DETAILED DESCRIPTION

Figure 1:
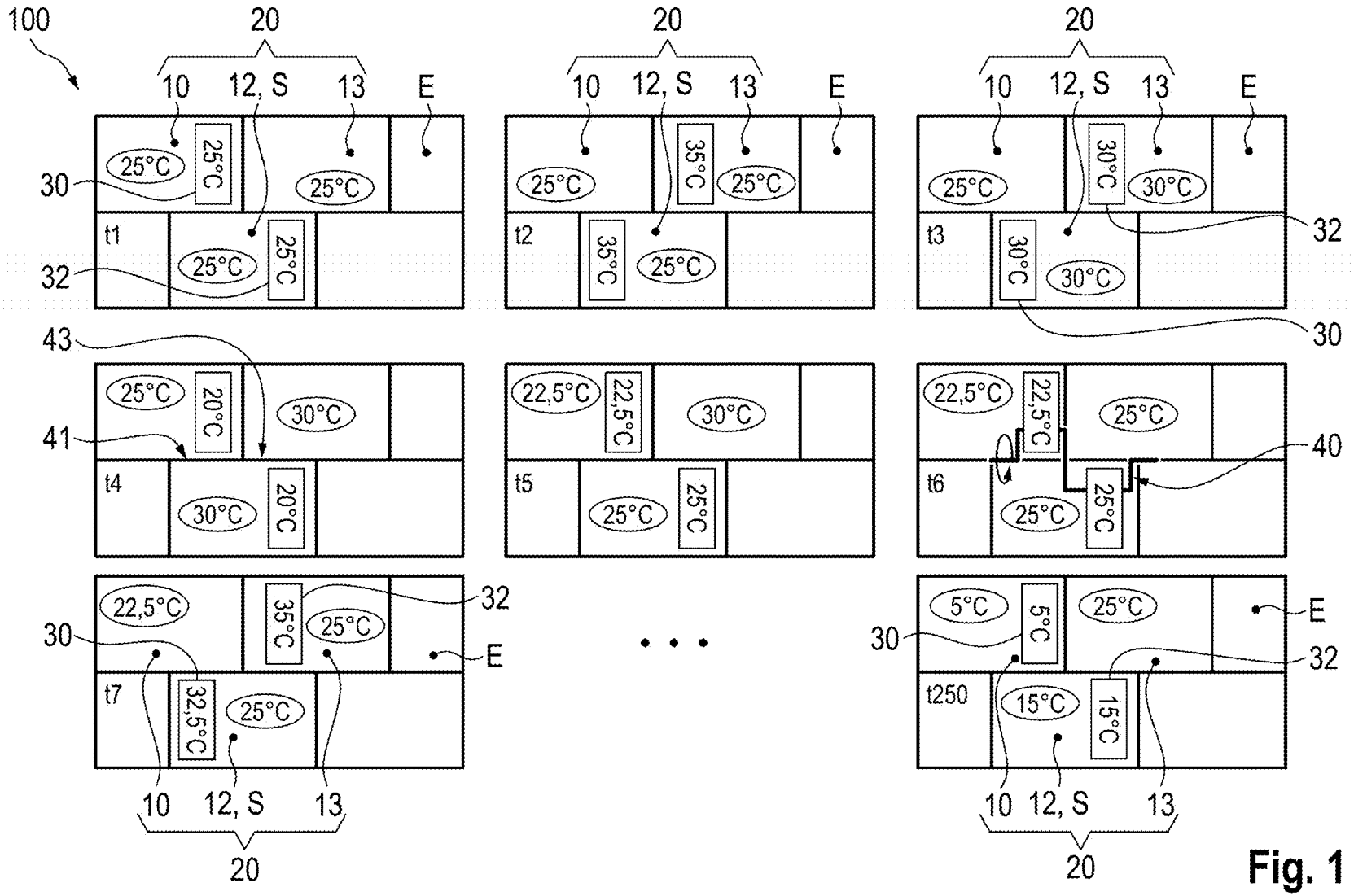
FIG. 1 shows a diagrammatic stepped view of a heat pump with two caloric accumulator elements.

To increase the efficiency of heat pumps, above all in transportation vehicles but also in stationary applications, elasto-caloric heat pumps can be used. The elasto-caloric effect is utilized in an elasto-caloric heat pump, a reversible temperature change being brought about by way of cyclical deformation of an elasto-caloric material, which temperature change can be utilized for the transfer of heat from a colder coolant flow to a warmer coolant flow. Elasto-caloric heat pumps of this type require a very large amount of installation space, however. In addition, the efficient conducting of the coolant is difficult. As an alternative or in addition, a thermo-electric material (known, for example, as a Peltier element or TEC) can be used, in the case of which a temperature change leads on account of the Seebeck effect to a current flow. As an alternative or in addition, an electro-caloric material can be used, in the case of which a temperature change leads on account of the pyro-electric effect to a voltage change. As an alternative or in addition, a magneto-caloric material can be used, in the case of which a temperature change changes the (magnetic) field strength as a consequence of a spin-lattice relaxation. It is a common feature of all these solid-body elements mentioned as an alternative that an external feed or discharge of energy brings about a temperature change, it being possible for this energy to be conducted electrically at least with a low cost of conversion, that is to say magnetically induced voltage, for example.

US 2015/0 369 524 A1 has disclosed a cooling/heating module which is configured to cool and heat air. The cooling/heating module comprises a first and a second cooling/heating portion which each comprise a thermo-elastic material. Furthermore, an actuator is provided which exerts stress on the thermo-elastic material. An actuator is configured in such a way that, in an alternating manner, it carries out the process of applying a stress to the thermo-elastic material of the first cooling/heating portion and the removal of the stress from the thermo-clastic material of the second cooling/heating portion and the process of applying a stress to the thermo-clastic material of the second cooling/heating portion and the removal of the stress from the thermo-clastic material of the first cooling/heating portion.

DE 10 2019 203 889 A1 has disclosed an apparatus for heat exchange which comprises a relatively rigid outer ring, a flexible inner ring, elasto-caloric elements which are clamped radially between the outer ring and the inner ring, and a rotating shaped element which has indentations and/or bulges which act on the inner ring.

WO 01/63 186 A1 discloses a heat transfer unit which comprises an active regenerative circuit. The heat transfer unit uses an active fluid and a heat transfer fluid which are separated physically from one another.

In comparison with previously known heat pumps, the disclosed embodiment solve the following problem simply and inexpensively: wherein a heat pump, a method for operating the heat pump, and a transportation vehicle are provided, in which an increased temperature rise can be achieved.

This is achieved by an intermediate accumulator being formed from at least one of the heat accumulators for transmitting heat between a heat accumulator in contact with a component to be temperature-controlled and the last heat accumulator.

This is also achieved by a method carried out by the heat pump as described herein:

i. if a temperature in the first heat accumulator deviates from a desired temperature, equalizing the temperature between the first heat accumulator and the first caloric accumulator element, by the first caloric accumulator element being positioned in the first heat accumulator;

ii. by external energy exchange between the first caloric accumulator element and an external energy source, changing the temperature of the first caloric accumulator element away from the desired temperature in such a way that a temperature difference in comparison with the temperature in the second heat accumulator is increased; and by the associated drive method or mechanism, moving the first caloric accumulator element from the first heat accumulator into the second heat accumulator;

iii. equalizing the temperature between the second heat accumulator and the first caloric accumulator element, by the first caloric accumulator element being positioned in thermally conducting contact with the second heat accumulator;

iv. by a reversed (in comparison with operation at ii.) external energy exchange between the first caloric accumulator element and an external energy source, changing the temperature of the first caloric accumulator element, and by the associated drive method or mechanism, moving the first caloric accumulator element from the second heat accumulator into the first heat accumulator, operation i. to operation iv.—being carried out in a temporally overlapping, optionally simultaneous, manner, in the same way from the at least one further caloric accumulator element between the second heat accumulator or the further heat accumulator and the further heat accumulator or the last heat accumulator, the method being repeated until the desired temperature is reached in the first heat accumulator.

Also disclosed is a transportation vehicle with a heat pump of this type, optionally operated by way of a method as described herein, being provided.

The disclosed heat pump comprises a plurality of heat accumulators which are arranged behind one another in a cascade; a plurality of caloric accumulator elements which are positioned in an alternating manner in in each case one of the heat accumulators; and at least one drive method or mechanism for changing the position of the accumulator elements between the heat accumulators, at least one of the heat accumulators being in contact with a component, to control the temperature of this component, a last one of the heat accumulators in the cascade being in heat exchange with surroundings.

This is achieved by an intermediate accumulator being formed from at least one of the heat accumulators for transmitting heat between a heat accumulator in thermally conducting contact with a component to be temperature-controlled and the last heat accumulator.

According to at least one disclosed embodiment, a cascade is a spatially staggered arrangement of the heat accumulators which are thermally decoupled from one another, an exchange of heat by way of wall conduction and/or leakage not necessarily being ruled out.

According to at least one disclosed embodiment, a respective accumulator element has precisely two end positions, a first one of the end positions being arranged in a first one of the heat accumulators, and a second end position being arranged in a second one of the heat accumulators, and it may be possible for an accumulator element of this type to be moved to and fro operationally exclusively between these two end positions. This corresponds to changing of the position of the accumulator elements between in each case precisely two of the heat accumulators.

In accordance with at least one disclosed embodiment, the drive method or mechanism is connected via a mechanism, for example, a crankshaft or camshaft, to one, a plurality or all of the accumulator elements in a movement-transmitting manner.

In accordance with at least one disclosed embodiment, the drive method or mechanism is configured for a lifting speed between two end positions of a relevant accumulator element of less than one tenth of a second, optionally at most one hundredth of a second.

In accordance with at least one disclosed embodiment, at least two, optionally all, of the accumulator elements can be moved exclusively simultaneously by the drive method or mechanism.

In accordance with at least one disclosed embodiment, a last one of the heat accumulators in the cascade is in direct contact with surroundings, optionally by an air-heat exchanger, particularly by way of a fan module.

In accordance with at least one disclosed embodiment, at least one of the heat accumulators is filled with a fluid, for example, with oil or with water or with a water/oil emulsion.

In accordance with at least one disclosed embodiment, at least one of the heat accumulators, optionally one or all of the intermediate accumulators, is a solid body.

In accordance with at least one disclosed embodiment, an intermediate accumulator is not in contact with surroundings, but rather is in heat exchange exclusively indirectly, to be precise in the sequence of the cascade, via the last heat accumulator with surroundings.

In accordance with at least one disclosed embodiment, a temperature change in the caloric accumulator element of at least 5 kelvins, optionally at least 10 K, can be brought about by energy which is fed in from the outside or dissipated to the outside, optionally as an electric current.

In accordance with at least one disclosed embodiment, a duration for changing the temperature of a caloric accumulator element is below five tenths of a second, optionally, at most, one tenth of a second.

In accordance with at least one disclosed embodiment, the caloric accumulator elements comprise at least one of the following materials:

a thermo-electric material, optionally comprising bismuth, tellurium, and particularly antimony;

an electro-caloric material, optionally comprising a terpolymer or a lead ceramic;

an elasto-caloric material, optionally comprising nickel and/or titanium, optionally formed from a nickel/titanium alloy or a nickel/titanium alloy with additional alloying elements such as copper, vanadium and cobalt; and a magneto-caloric material, optionally comprising gadolinium or lanthanum.

In accordance with at least one disclosed embodiment, a thermo-electric material is a Bi2Te3 alloy or a Bi—Sb—Te alloy.

In accordance with at least one disclosed embodiment, an electro-caloric material is P(VDF-TrFE-CFE), P(VDF-TrFE) or Pb(ZrTi)O3.

In accordance with at least one disclosed embodiment, an elasto-caloric material is Cu—Al—Ni, NiTiCo, NiTi, NiTiCu or CuZn—Al, NiTiCuV.

In accordance with at least one disclosed embodiment, a magneto-caloric material is Gd5(Si,Ge)4, La(Fe,Co,Si)13, La(Fe,Si)13 or Gd.

In accordance with at least one disclosed embodiment, at least one, optionally all, of the caloric accumulator elements comprises/comprise an elasto-caloric material, and the elasto-caloric material is deformable for a temperature change of the relevant accumulator element.

In accordance with at least one disclosed embodiment, a drive movement which is carried out by the drive method or mechanism which belongs to this accumulator element to move this accumulator element between the changing positions in thermally conducting contact with the associated heat accumulators together with the deformation of the elasto-caloric material is a circular or linear movement.

In accordance with at least one disclosed embodiment, an accumulator element carries out a linear movement between the changing positions in thermally conducting contact with the associated heat accumulators.

In accordance with at least one disclosed embodiment, an elastic compression or stretch of the elasto-caloric material can be carried out by a torque of the drive method or mechanism, optionally comprising an electric motor as torque source.

In accordance with at least one disclosed embodiment, an elliptical movement can be carried out by a crankshaft or camshaft, optionally driven by a torque by a rotor of an electric motor.

In accordance with at least one disclosed embodiment, the movements of the elasto-caloric accumulator elements are synchronized with respect to one another, optionally by a crankshaft or camshaft.

In accordance with at least one disclosed embodiment, the movement of at least one of the accumulator elements comprises tilting or twisting within itself with the consequence of an elastic compression or stretch as a consequence of this tilting or twisting within itself.

In accordance with at least one disclosed embodiment, it is possible for the elasto-caloric material of at least one, optionally all, of the accumulator elements to be subjected to both a compressive load and a tensile load by the respective associated drive method or mechanism.

In accordance with at least one disclosed embodiment, a temperature increase can be brought about in the elasto-caloric accumulator element as a consequence of a compressive load or tensile load, and a temperature drop can be brought about in the elasto-caloric accumulator element as a consequence of a relief.

In accordance with at least one disclosed embodiment, a heat accumulator, in which the relevant accumulator element is currently positioned, can be heated and conversely can also be cooled by the elasto-caloric accumulator element.

In accordance with at least one disclosed embodiment, in each case one dividing element is arranged between in each case two heat accumulators to divide them fluidically, it being possible for an accumulator element to be guided through an associated dividing element to change its position between the heat accumulators, it may be possible for the accumulator element which is to be guided through the dividing element to be moved exclusively perpendicularly with respect to the dividing element.

In accordance with at least one disclosed embodiment, the dividing element is formed by at least one dividing wall.

In accordance with at least one disclosed embodiment, the dividing element has an opening, through which a structural element is guided, on which at least one, optionally in each case a single, caloric accumulator element and a guiding sealing element are arranged, the associated opening of the dividing element being sealed by the sealing element at least at the end positions of the relevant accumulator element.

In accordance with at least one disclosed embodiment, the purely perpendicular relative movement with respect to the dividing element is superimposed by tilting or twisting of the relevant accumulator element within itself.

In accordance with at least one disclosed embodiment, at least one of the heat accumulators is a duct of a circuit line for a coolant.

In accordance with at least one disclosed embodiment, a heat accumulator is a closed vessel, circulation of a heat exchanger fluid optionally taking place in the vessel.

In accordance with at least one disclosed embodiment, the fluid which is situated in the heat accumulator which is configured as a duct is a permanently circulated coolant of a thermal management module [TMM], or of a part circuit of a TMM of this type.

In accordance with at least one disclosed embodiment, at least two of the heat accumulators are configured to control the temperature of in each case at least one component.

In accordance with at least one disclosed embodiment, a first heat accumulator is configured for a first temperature level as desired temperature, and another heat accumulator is configured for another temperature level as desired temperature.

In accordance with at least one disclosed embodiment, a desired temperature for a first heat accumulator is more volatile than a desired temperature for a second heat accumulator.

In accordance with at least one disclosed embodiment, a first heat accumulator is filled with a different fluid than another heat accumulator, for example, one heat accumulator with oil and one heat accumulator with water or a water/oil emulsion or with a refrigerant.

In accordance with a further exemplary embodiment, a method for operating a heat pump in accordance with at least one disclosed embodiment according to the above description is proposed, having the following operations:

i. if a temperature in the first heat accumulator deviates from a desired temperature, equalizing the temperature between the first heat accumulator and the first caloric accumulator element, by the first caloric accumulator element being positioned in thermally conducting contact with the first heat accumulator;

ii. by external energy exchange between the first caloric accumulator element and an external energy source, changing the temperature of the first caloric accumulator element away from the desired temperature in such a way that a temperature difference in comparison with the temperature in the second heat accumulator is increased; and by the associated drive method or mechanism, moving the first caloric accumulator element away from its position in thermally conducting contact with the first heat accumulator into a position in thermally conducting contact with the second heat accumulator;

iii. equalizing the temperature between the second heat accumulator and the first caloric accumulator element, by the first caloric accumulator element being positioned in thermally conducting contact with the second heat accumulator;

iv. by a reversed (in comparison with operation at ii.) external energy exchange between the first caloric accumulator element and an external energy source, changing the temperature of the first caloric accumulator element; and by the associated drive method or mechanism, moving the first caloric accumulator element away from its position in thermally conducting contact with the second heat accumulator into a position in thermally conducting contact with the first heat accumulator;

operation at i. to operation at iv. being carried out in a temporally overlapping, optionally simultaneous, manner, in the same way from the at least one further caloric accumulator element between the second heat accumulator or the further heat accumulator and the further heat accumulator or the last heat accumulator, the operations of the method being repeated until the desired temperature is reached in the first heat accumulator.

In accordance with at least one disclosed embodiment, in operation at ii. and/or in operation at iv., the moving and the changing of the temperature are carried out at the same time, so as to overlap temporally, or before or after one another.

In accordance with at least one disclosed embodiment, an accumulator element is moved between heat accumulators in a temperature-controlled manner.

In accordance with at least one disclosed embodiment, an accumulator element is moved between heat accumulators in a calorically controlled manner, the accumulator element being moved into the respective other heat accumulator after the transfer of a predefined quantity of heat.

In accordance with at least one disclosed embodiment, all the accumulator elements are moved at the same time, for example, if a predefined temperature is reached in a single one of the accumulator elements and/or a predefined quantity of heat has been transferred to the respective heat accumulator by a single one of the accumulator elements.

In accordance with at least one disclosed embodiment, in operation at i. and in operation at iii., the equalizing of the temperatures is carried out in a passive manner, that is to say exclusively by heat radiation, free convection and/or heat conduction.

In accordance with at least one disclosed embodiment, the analogous operations of the further caloric accumulator elements are carried out synchronously with, and optionally identically to, the operations at i. to iv. described here.

In accordance with at least one disclosed embodiment, furthermore, the following operations are included:

v. if a further temperature in at least one further one of the heat accumulators deviates from a desired temperature, equalizing the temperature between the relevant heat accumulator and a caloric accumulator element which is positioned in thermally conducting contact with the relevant heat accumulator;

vi. by external energy exchange between the relevant caloric accumulator element and an external energy source, changing the temperature of this caloric accumulator element away from the desired temperature in such a way that a temperature difference in comparison with the temperature in the second heat accumulator is increased; and by the associated drive method or mechanism, moving the relevant caloric accumulator element away from its position in thermally conducting contact with the relevant heat accumulator into a position in thermally conducting contact with another heat accumulator, in the same way as operation at iii. to operation at iv., a reversed energy exchange and a reversed movement of the relevant caloric accumulator element being carried out in a operation at vii. to an operation at viii., and operation at v. to operation at viii. being repeated until the desired temperature is reached in the relevant heat accumulator, operation at i. to operation at iv. and operation at v. to operation at viii. optionally being carried out in a temporally overlapping manner.

In accordance with at least one disclosed embodiment, in operation at vi. and/or in operation at viii., the moving and the changing of the temperature are carried out at the same time, so as to overlap temporally, or before or after one another.

In accordance with at least one disclosed embodiment, in operation at v. and in operation at vii., the equalizing of the temperatures is carried out in a passive manner, that is to say exclusively by heat radiation, free convection and/or heat conduction.

In accordance with at least one disclosed embodiment, the analogous operations of the further caloric accumulator elements are carried out synchronously with, and optionally identically to, the operations at v. to viii. and/or the operations at i. to iv. described here.

In accordance with a further exemplary embodiment, a transportation vehicle is proposed, comprising at least one component to be temperature-controlled and a heat pump in accordance with at least one disclosed embodiment according to the above description for the component to be temperature-controlled, it may be possible for the component to be temperature-controlled to be temperature-controlled by a method in accordance with at least one disclosed embodiment according to the above description.

In accordance with at least one disclosed embodiment, a component to be temperature-controlled is a drive unit for propulsion, a high-voltage battery, a pulse width modulated inverter, an electronic power system and/or the air flow for the climate control of the vehicle interior compartment of the transportation vehicle.

In accordance with at least one disclosed embodiment, a component to be temperature-controlled is a vehicle interior compartment.

In accordance with a further exemplary embodiment, it is proposed for a heat pump in accordance with at least one disclosed embodiment according to the above description to be used for a stationary component to be temperature-controlled, it may be possible for the stationary component to be temperature-controlled to be temperature-controlled by a method in accordance with at least one disclosed embodiment according to the above description.

FIG. 1 shows a diagrammatic stepped view of a heat pump 100 with two caloric accumulator elements 30, 31. Each of the eight rectangles shown is structurally identical and in each case shows the same heat pump 100 with the respective cascade 20. The reference signs are purely representationally placed only in part, but can be transferred analogously to each of the rectangles. The cascade 20 comprises a first heat accumulator 10 which is arranged next to a third heat accumulator 12 in a manner which is decoupled thermally via a first dividing element 41. It is to be noted that the ordinal number 2, that is to say relating to the second heat accumulator 11, the second dividing element 42 and the second caloric accumulator element 31, is omitted here for the sake of unity of the description with the exemplary embodiment according to FIG. 2, and does not appear in this exemplary embodiment. Furthermore, each of the eight rectangles which are shown comprises a fourth heat accumulator 13 as the last one which is arranged next to the third heat accumulator 12 in a manner which is decoupled thermally via a third dividing element 43. A first caloric accumulator element 30 can be moved between the first heat accumulator 10 and the third heat accumulator 12 through the first dividing element 41, with the result that a position of the first caloric accumulator element 30 in the first heat accumulator 10 and a position of the first caloric accumulator element 30 in the third heat accumulator 12 can therefore be changed. A last caloric accumulator element 32 can equally be moved between the third heat accumulator 12 and the last heat accumulator 13 through the last dividing element 43, with the result that a position of the last caloric accumulator element 32 in the third heat accumulator 12 and a position of the last caloric accumulator element 32 in the last heat accumulator 13 can therefore be changed.

It is to be noted that, in the case of at least one disclosed embodiment, the respective accumulator element is not positioned in the respective heat accumulator, but rather is (positioned) exclusively in thermally conducting contact with the (that is to say, on the) respective heat accumulator, for example, comes into contact with an outer wall of the respective heat accumulator, and the exchange of heat then takes place via heat conduction between these solid bodies. For example, an elasto-caloric wire or an elasto-caloric band then transmits heat via contact to, for example, an aluminum housing of the relevant heat accumulator. In addition or as an alternative, the heat can then be transferred within the heat accumulator to a fluid which is situated in the heat accumulator by way of heat transfer. Furthermore, it is to be noted that all or some of the heat accumulators (optionally in the case of the intermediate accumulators S) consist exclusively of a solid body and do not contain any fluid.

Here, the third heat accumulator 12 is an intermediate accumulator S, that is to say is in direct contact for heat exchange neither with the first component 50 nor with the surroundings E, but rather exclusively by the first heat accumulator 10 or the last heat accumulator 13. It is not necessarily ruled out here, however, that the third heat accumulator 12 is in direct heat exchange with a further component. This is not taken into consideration in the case of the operations which are shown, however. The last heat accumulator 13 is in heat exchange, optionally directly, with the surroundings E, for example, via an air-heat exchanger.

In the uppermost row and left-hand column, at the time t1, the heat pump 100 is shown at an initial temperature, all of the heat accumulators 10, 12, 13 and also the caloric accumulator elements 30, 32 being at a temperature of 25° C.

In the middle column at the top, it is shown subsequently to the time t2 that the accumulator elements 30, 32 have both changed their position, and have been heated by 10 kelvins in a temporally overlapping manner by way of external energy supply. In the case of an elasto-caloric material of the accumulator elements 30, 32, an accumulator element 30, 32 of this type has been deformed, for example, by application of a torque, and the temperature rise is brought about as a consequence of a phase transition of the structure from austenite to martensite. As an alternative or in addition, in the case of a different caloric material, the temperature increase is brought about by supplying electric energy, in the case of a thermo-electric material as a current flow, in the case of an electro-caloric material, such as, raising of the electric voltage, and in the case of a magneto-caloric material, such as an increased field strength of an electrically induced magnetic field.

At the top in the right-hand column, it is shown subsequently to the time t3 how the temperatures in the heat accumulators 12, 13 have been equalized with the respective caloric accumulator element 30, 32.

On the left-hand side in the middle row, it is shown subsequently to the time t4 that the accumulator elements 30, 32 have both changed their position, and have been cooled by 10 kelvins in a temporally overlapping manner by way of external energy dissipation. In the case of an elasto-caloric material of the accumulator elements 30, 32, an accumulator element 30, 32 of this type has been relieved, for example, by relieving, for example, by canceling, the effect of a previously applied torque, with the result that it has expanded again and the temperature rise is brought about as a consequence of a phase transition of the structure from martensite to austenite. As an alternative or in addition, in the case of a different caloric material, the temperature decrease is brought about by discharging of electric energy, in the case of a thermo-electric material as a reversed current flow in comparison with the above-described procedure in relation to the middle column at the top, in the case of an electro-caloric material as a decrease in the electric voltage, that is to say with a reversed sign with respect to the above procedure, and in the case of a magneto-caloric material as a removal or considerable reduction of a field strength of an electrically induced magnetic field.

In the middle column in the middle row, it is shown subsequently to the time t5 how the temperatures in the heat accumulators 10, 12 have equalized with the respective caloric accumulator element 30, 32.

On the right-hand side in the middle column, it is shown at the same time as or subsequently to the time t6 how the temperature in the last heat accumulator 13 has decreased with the aid of the surroundings E.

From now on, this cycle is repeated multiple times subsequently in the lowest row from the left from time t7 until the desired temperature is reached in the first heat accumulator 10 in the last row on the right here at the time t250.

Figure 2:
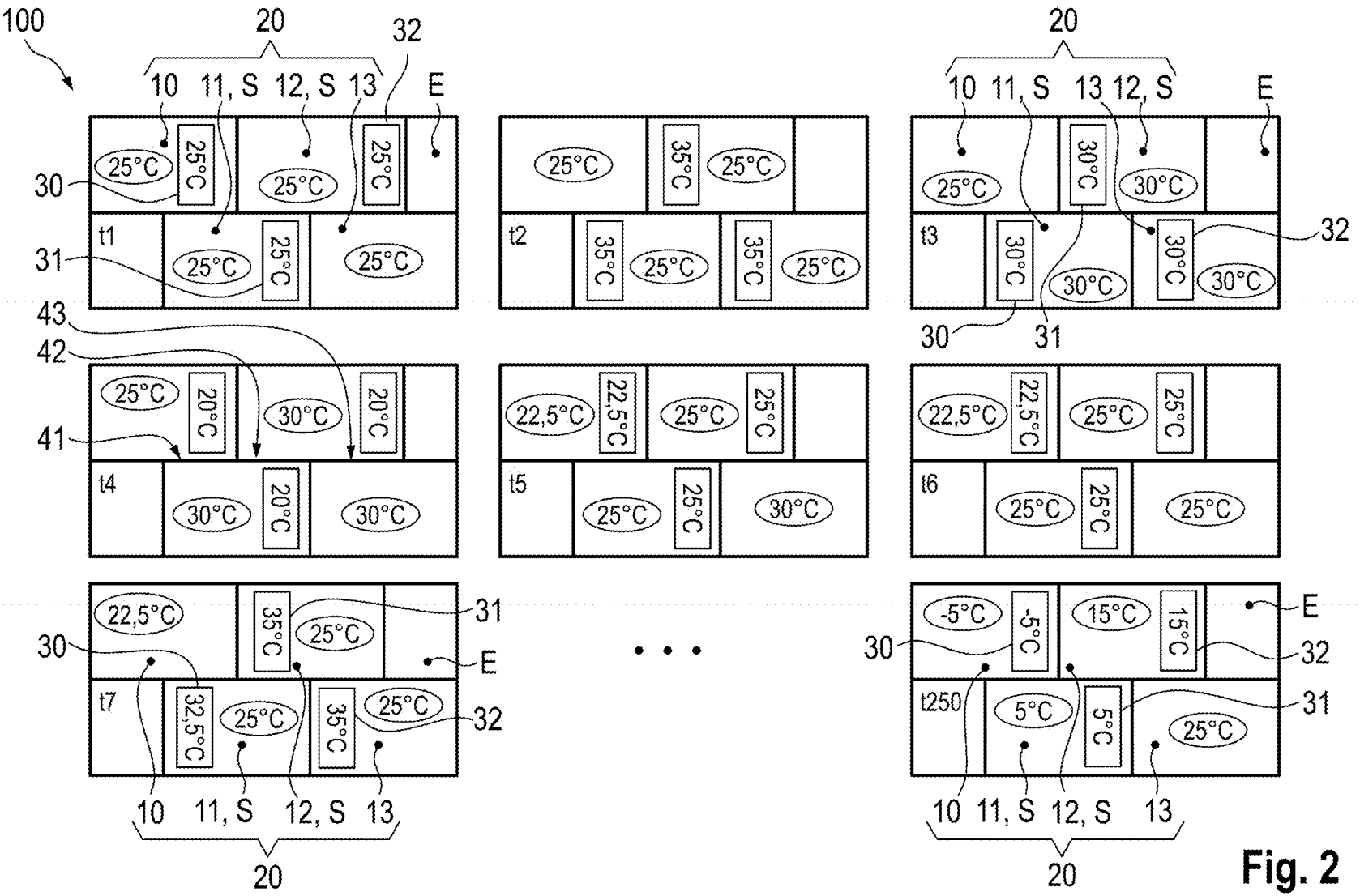
FIG. 2 shows a diagrammatic stepped view of a heat pump with three caloric accumulator elements.

FIG. 2 shows a diagrammatic stepped view of a heat pump 100 with three caloric accumulator elements 30, 31, 32. Here too, each of the eight rectangles which are shown are structurally identical in accordance with the same illustration principle, and in each case shows the same heat pump 100 with the respective cascade 20. Here too, the reference signs are representatively positioned only in part, but can be transferred analogously to each of the rectangles. Here, in addition to the heat accumulators 10, 12, 13 which are described in FIG. 1, the cascade 20 comprises a second heat accumulator 11 which is arranged next to the first heat accumulator 10 in a thermally decoupled manner via a first dividing element 41, and the next to the third heat accumulator 12 in a manner which is thermally decoupled via a second dividing element 42. Each of the eight rectangles which are shown comprises, furthermore, a second caloric accumulator element 31 which can be moved through the second dividing element 42, with the result that a position of the second caloric accumulator element 31 in (or on) the third heat accumulator 12 and a position of the second caloric accumulator element 31 in (or on) the fourth (last) heat accumulator 13 can therefore be changed. Here, just like the last heat accumulator 13, the second heat accumulator 11 is an intermediate accumulator S, that is to say is in direct contact for heat exchange neither with the first component 50 nor with the surroundings E, but rather exclusively by the first heat accumulator 10 or the third heat accumulator 12 and the last heat accumulator 13. It is not necessarily ruled out here, however, that, just like the last heat accumulator 13, the third heat accumulator 12 is in direct heat exchange with a further component 51. In the case of the operations which are shown, however, this is not taken into consideration here either. Here too, the last heat accumulator 13 is in heat exchange, optionally directly, with the surroundings E, for example, via an air-heat exchanger. For further details, reference is made as far as possible to FIG. 1 and the associated description purely for the sake of clarity without excluding generality.

In the uppermost row and left-hand column, the heat pump 100 is shown at a starting temperature at the time t1, all the heat accumulators 10, 11, 12, 13 and the caloric accumulator elements 30, 31, 32 being at a temperature of 25° C.

In the middle column at the top, it is shown subsequently to the time t2 that the accumulator elements 30, 31, 32 have all changed their position and have been heated by 10 kelvins in a temporally overlapping manner by way of external energy supply.

At the top in the right-hand column, it is shown subsequently to the time t3 how the temperatures in the heat accumulators 11, 12, 13 have equalized with the respective caloric accumulator element 30, 31, 32.

On the left-hand side in the middle row, it is shown subsequently to the time t4 that the accumulator elements 30, 31, 32 have all changed their position and have been cooled by 10 kelvins in a temporally overlapping manner by way of external energy discharge.

In the middle column in the middle row, it is shown subsequently to the time t5 how the temperatures in the heat accumulators 10, 11, 12 have equalized with the respective caloric accumulator element 30, 31, 32.

On the right-hand side in the middle column, it is shown at the same time as or subsequently to the time t6 how the temperature in the last heat accumulator 13 has decreased with the aid of the surroundings E.

From now on, this cycle is repeated multiple times subsequently from the left in the lowermost row from time t7 until the desired temperature is reached in the first heat accumulator 10 on the right in the last row, here at the time t250.

Figure 3:
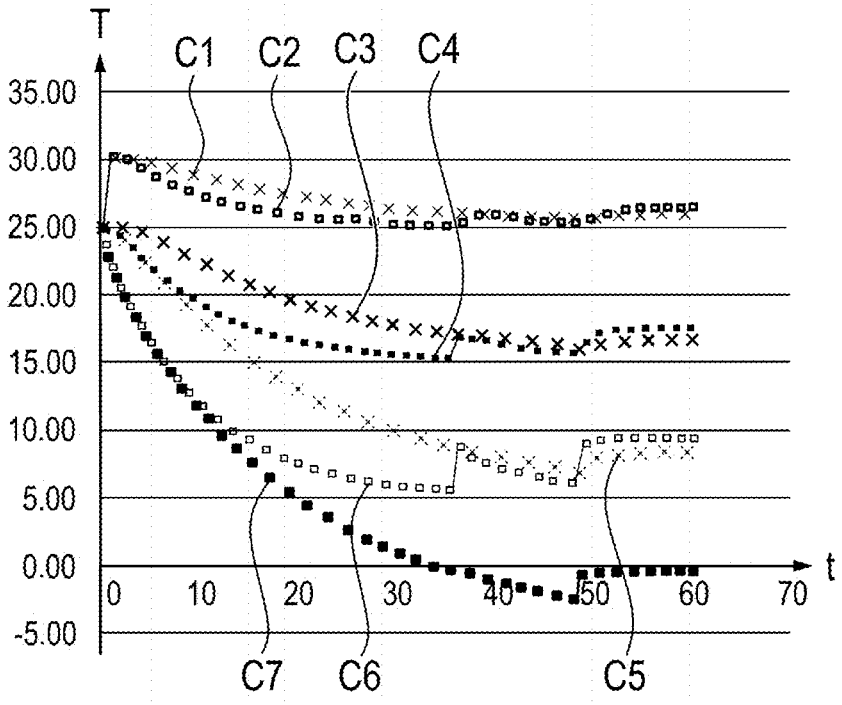
FIG. 3 shows a diagram with the temperature changes in a heat pump according to FIG. 1 and FIG. 2.

FIG. 3 shows a diagram with the temperature changes in a heat pump 100 according to FIG. 1 and according to FIG. 2. The abscissa is the time axis t or the cycles, and the ordinate is the temperature axis T in degrees Celsius. The crosses and square dots of the curves C1, C2, C3, C4, C5, C6, C7 represent a respective cycle, that is to say two changes or a forward change and a change back of the positions of the two caloric accumulator elements 30, 31 according to FIG. 1 or three caloric accumulator elements 30, 31, 32 according to FIG. 2, as described, for example, in FIG. 5 with the operations at i. to iv. In the case of the starting point at the time 0, the heat accumulators 10, 11, 12, 13 are in equilibrium with one another at 25° C. In the case of this example, a quantity of heat in the first heat accumulator 10 is constant for illustrative purposes and without exclusion of generality purely for the sake of clarity. In this case, the first heat accumulator 10 is cooled down. It is to be noted that this is also readily possible in a reversed manner by way of the cascade 20 and the movable accumulator elements 30, 31, 32, that is to say the first heat accumulator 10 can also be heated.

The uppermost curve C1 with crosses shows the quasi-iterative temperature profile in the fourth (last) heat accumulator 13 of the heat pump 100 in the exemplary embodiment according to FIG. 1. The curve C2 which is second from the top with square dots shows the quasi-iterative temperature profile in the fourth (last) heat accumulator 13 of the heat pump 100 in the exemplary embodiment according to FIG. 2. Both of these curves C1, C2 start at 25° C. in this example, and are raised to 30° C. by way of the first cycle, and are then gradually shifted in the direction of 25° C. with each cycle and are held there. The cooling is achieved, for example, by the air 52 from the surroundings E which has a constant temperature here for illustrative purposes and without excluding generality purely for the sake of clarity.

The curve C3 which follows underneath with crosses shows the quasi-iterative temperature profile in the second heat accumulator 12 of the heat pump 100 in the exemplary embodiment according to FIG. 1, by which a pure intermediate accumulator S is formed here. The curve C4 which follows underneath with square dots shows the quasi-iterative temperature profile in the third heat accumulator 12 of the heat pump 100 in the exemplary embodiment according to FIG. 2, by which a pure intermediate accumulator S is likewise formed here. Both of these curves C3, C4 of the curve pair second from the top in the illustration of the diagram start at 25° C. in this example, and are shifted with an excessive rise in the direction of 15° C., in the direction of approximately 17° C., and are held there.

Figure 4:
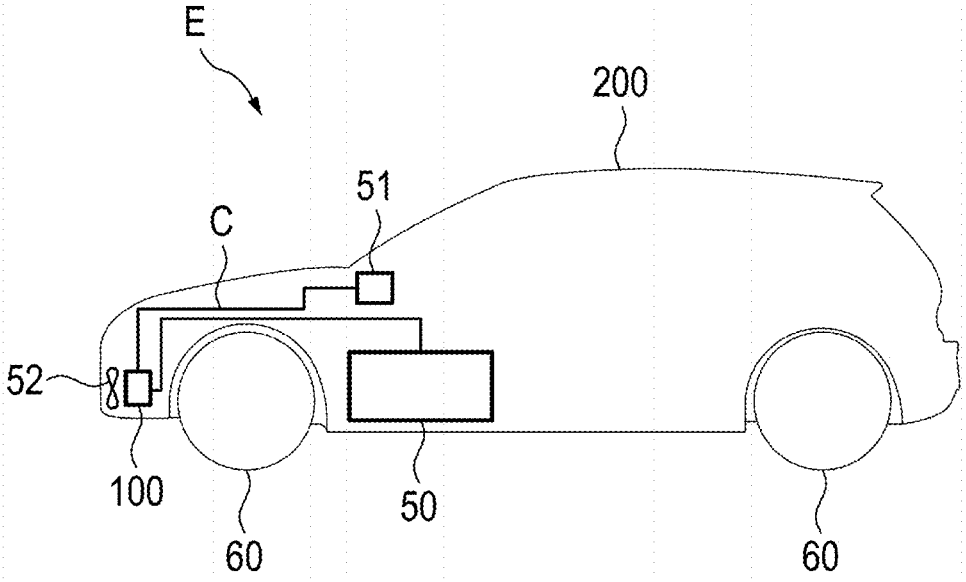
FIG. 4 shows a transportation vehicle with components to be temperature-controlled and a heat pump.

The lowermost curve C7 with square dots shows the quasi-iterative temperature profile in the first heat accumulator 10 of the heat pump 100 in the exemplary embodiment according to FIG. 2, by which direct contact with a component 50, 51 to be temperature-controlled, as shown in FIG. 4, for example, is formed. This curve C7 starts at 25° C. in this example, and is then shifted gradually with each cycle in the direction of −5° C., and from there is raised again to 0° C. and held there. The component 50, 51 to be temperature-controlled is to be temperature-controlled in this case by way of a fluid at approximately 0° C., the desired temperature here, that is to say in this case is cooled down from 25° C.

The following curve C6 above this with square dots shows the quasi-iterative temperature profile in the second heat accumulator 11 of the heat pump 100 in the exemplary embodiment according to FIG. 2, by which a pure intermediate accumulator S is formed here. The following curve C4 above this with square dots shows the quasi-iterative temperature profile in the third heat accumulator 12 of the heat pump 100 in the exemplary embodiment according to FIG. 2, by which a pure intermediate accumulator S is likewise formed here.

The third curve C5 from the bottom with crosses shows the quasi-iterative temperature profile in the first heat accumulator 10 of the heat pump 100 in the exemplary embodiment according to FIG. 1, by which direct contact with a component 50, 51 to be temperature-controlled, as shown in FIG. 4, for example, is formed. This curve C5 starts at 25° C. in this example, and is then gradually shifted in the direction of 5° C. with each cycle, and is raised from there again to 10° C. and is held there. The component 50, 51 to be temperature-controlled is to be temperature-controlled in this case by way of a fluid at approximately 10° C., the desired temperature here, that is to say is to be cooled down from 25° C. in this case. It can be seen here by way of this that the temperature is decreased in a considerably more pronounced manner by way of the additional heat accumulator 11 than by way of fewer heat accumulators.

FIG. 4 shows a diagrammatic side view of a transportation vehicle 200 with components 50, 51 to be temperature-controlled and a heat pump 100 which are thermally connected by a circuit line C with a fluid as heat exchanger, for example, as thermal management module or as part of a module of this type. Here, a first component 50 is, for example, a drive unit for propulsion via the wheels 60 and/or a high-voltage battery. The second component 51 is, for example, the feed air duct for controlling the temperature of a vehicle interior compartment. A heat pump 100 is shown diagrammatically at the front in the transportation vehicle 200, which heat pump 100 can be temperature-controlled here optionally via a fan 52 by way of forced convection to the surroundings E. Further components are, for example, a high-voltage battery, a pulse width modulated inverter, an on-board charging unit and further components which are thermally loaded or are to be kept within a tight temperature range. The heat pump 100 which is proposed here is equally suitable for stationary applications such as, for example, a stationary high-voltage battery, an AC/DC converter, but also other units which develop heat and/or are sensitive to heat.

Figure 5:
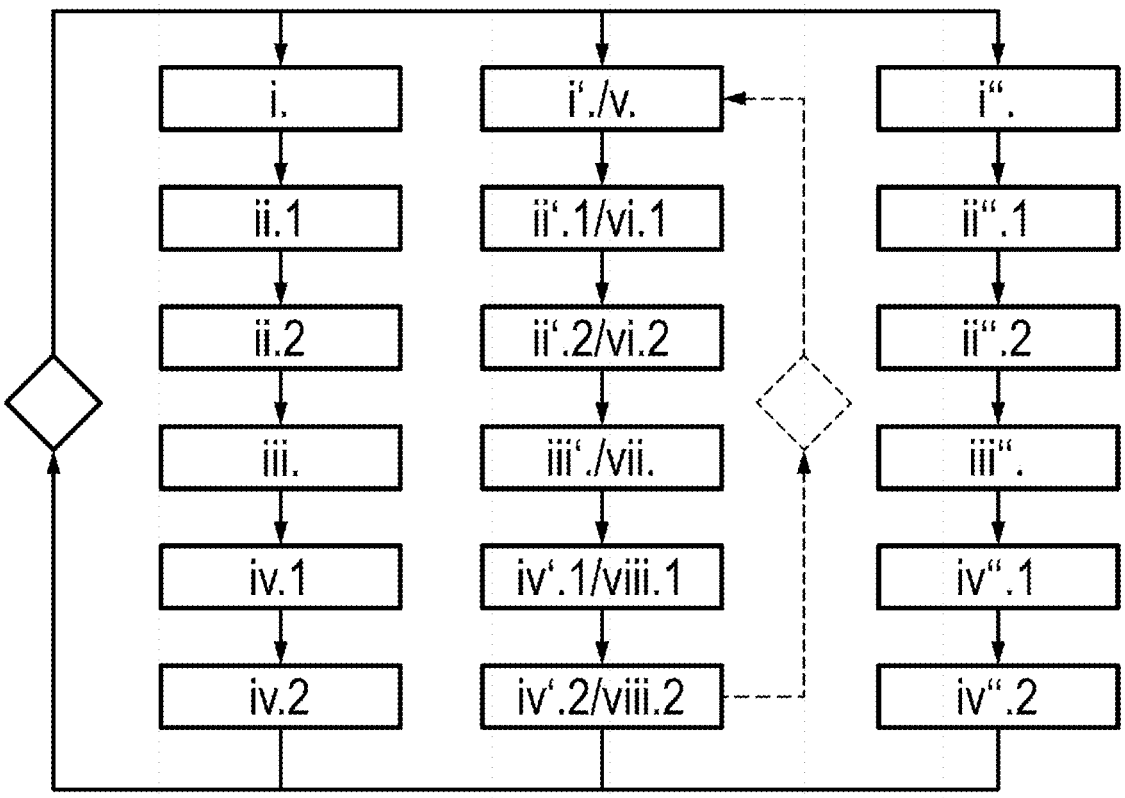
FIG. 5 shows a flow chart of a method for operating a heat pump according to FIG. 1 or FIG. 2.

FIG. 5 shows a flow chart of a method for operating a heat pump 100 according to FIG. 1, with exclusively the operations at i. and i". and onward, or FIG. 2, with operations at i., i'. and i". and onward. In operation at i., in the case of a temperature in the first heat accumulator 10 deviating from a desired temperature, the temperature between the first heat accumulator 10 and the first caloric accumulator element 30 is equalized, by the first caloric accumulator element 30 being positioned in or on the first heat accumulator 10. In operation at ii., the temperature of the first caloric accumulator element 30 is equalized away from the desired temperature by external energy exchange between the first caloric accumulator element 30 and an external energy source, in such a way that a temperature difference in comparison with the temperature in the second heat accumulator 11 is increased, and the first caloric accumulator element 30 is moved from the first heat accumulator 10 into the second heat accumulator 11 by the associated drive method or mechanism 40. In operation at iii., the temperature between the second heat accumulator 11 and the first caloric accumulator element 30 is equalized, by the first caloric accumulator element 30 being positioned in or on the second heat accumulator 11. In operation at iv., the temperature of the first caloric accumulator element 30 is changed by an external energy exchange, reversed in comparison with operation at ii., between the first caloric accumulator element 30 and an external energy source, and the first caloric accumulator element 30 is moved from the second heat accumulator 11 into the first heat accumulator 10 by the associated drive method or mechanism 40.

In a temporally overlapping manner (shown here at the same time), in operations at i'. to iv'., the second caloric accumulator element 31 is moved in the same way between the second heat accumulator 11 and the third heat accumulator 12 in the case of a corresponding temperature equalization and a corresponding, optionally identical, temperature change as a consequence of external energy exchange. In a temporally overlapping manner (shown here at the same time), in operations at i". to iv"., the third or last caloric accumulator element 31 is moved in the same way between the third heat accumulator 12 and the fourth or last heat accumulator 13 in the case of a corresponding temperature equalization and a corresponding, optionally identical, temperature change as a consequence of external energy exchange.

The indicated operations of the method are repeated until the desired temperature is reached in the first heat accumulator 10. It is not ruled out in this way that the method is interrupted as a consequence of an excessive rise. Rather, an approximation to a desired temperature is carried out along a regulation curve, for example, with an excessive rise as a consequence of evening out. Achieving of the desired temperature therefore means that this temperature is reached in a stable manner.

Here, in a superimposed manner (shown here at the same time), in operation sat v. to viii., the second caloric accumulator element 31 is moved here in the same way between the second heat accumulator 11 and the third heat accumulator 12 in the case of a corresponding temperature equalization and a corresponding, optionally identical, temperature change as a consequence of external energy exchange. The difference here is that the second heat accumulator 11 is at the same time in (for example, direct) contact with a second component 51, while the first heat accumulator 10 is in (for example, direct) contact with a first component 50 for heat exchange. Therefore, a second desired temperature is to be adjusted for this second component 51, that is to say for the second heat accumulator 11. The exhaust heat or else the heat to be absorbed can be discharged here both by the first heat accumulator 10 and by the third heat accumulator 12, or as an alternative or in addition indirectly or directly by the surroundings E, or can be removed from there. This is regulated, for example, as required in a manner which is dependent on the state. It is to be noted that the relevant heat accumulator 10, 12 therefore then also has to be regulated, as described above, that is to say in a manner which is dependent on the desired temperature in the second heat accumulator 11.

It is to be noted that the desired temperature can vary in a real application, and the ambient temperature is in part considerably variable, especially during a car journey. Cross inputs of heat into the elements of the heat pump 100 are not ruled out either. The process according to FIG. 1 and FIG. 2 will therefore usually not correspond to any real application, but rather merely shows the method which forms the basis, with a pronounced restriction of the boundary conditions.

LIST OF REFERENCE SIGNS

100 Heat pump
200 Transportation vehicle
10 First heat accumulator
11 Second heat accumulator
12 Third heat accumulator
13 Fourth (last) heat accumulator
20 Cascade
30 First caloric accumulator element
31 Second caloric accumulator element
32 Third (last) caloric accumulator element
40 Drive method or mechanism
41 First dividing element
42 Second dividing element
43 Third (last) dividing element
50 First component
51 Second component
52 Fan
60 Impeller
S Intermediate accumulator
E Surroundings
C Circuit line
t Time axis
T Temperature axis
C1 First curve
C2 Second curve
C3 Third curve
C4 Fourth curve
C5 Fifth curve
C6 Sixth curve
C7 Seventh curve

The invention claimed is:

1. A heat pump comprising:

a plurality of heat accumulators arranged behind one another in a cascade;

a plurality of caloric accumulator elements positioned alternatingly in thermally conducting contact with, in each case, one of the plurality of heat accumulators; and at least one drive mechanism for changing a position of the each of the plurality of caloric accumulator elements between the plurality of cascaded heat accumulators, wherein at least one of the plurality of the cascaded heat accumulators is in contact with a component to control the temperature of the component such that the component is temperature-controlled, wherein a last one of the plurality of cascaded heat accumulators is in heat exchange with surroundings of the heat pump, and wherein an intermediate accumulator of the plurality of cascaded heat accumulators is configured to transmit heat between the cascaded heat accumulator in contact with the temperature-controlled component and the last heat accumulator.

2. The heat pump of claim 1, wherein each of the plurality of caloric accumulator elements comprise at least one of the following materials:

a thermo-electric material from the group comprising bismuth, tellurium, and antimony;

an electro-caloric material from the group comprising a terpolymer or a lead ceramic;

an elasto-caloric material from the group comprising nickel and/or titanium formed from a nickel/titanium alloy or a nickel/titanium alloy with additional alloying elements such as copper, vanadium and cobalt; and a magneto-caloric material from the group comprising gadolinium or lanthanum.

3. The heat pump of claim 1, wherein at least one of the plurality of caloric accumulator elements comprises an elasto-caloric material, and the elasto-caloric material is deformable for a temperature change of the relevant caloric accumulator element, and wherein a drive movement is carried out by the drive mechanism together with the deformation of the elasto-caloric material in a circular or linear movement to move the caloric accumulator elements between the changing positions in thermally conducting contact with the associated heat accumulators.

4. The heat pump of claim 3, wherein the elasto-caloric material of at least one of the caloric accumulator elements is subjected to both a compressive load and a tensile load by the drive movement.

5. The heat pump of claim 1, wherein one dividing element is positioned arranged between two heat accumulators of the plurality of cascaded heat accumulators to divide them fluidically, wherein one of the plurality of caloric accumulator elements is guided through an associated dividing element to change its position between the plurality of cascaded heat accumulators.

6. The heat pump of claim 1, wherein at least one of the plurality of cascaded heat accumulators is a duct of a circuit line for a coolant.

7. The heat pump of claim 1, wherein at least two of the plurality of cascaded heat accumulators are configured to control the temperature of, in each case, at least one temperature-controlled component.

8. A method for operating a heat pump that includes a plurality of heat accumulators arranged behind one another in a cascade, a plurality of caloric accumulator elements positioned alternatingly in thermally conducting contact with, in each case, one of the plurality of heat accumulators, and at least one drive mechanism for changing a position of the each of the plurality of caloric accumulator elements between the plurality of cascaded heat accumulators, wherein at least one of the plurality of the cascaded heat accumulators is in contact with a component to control the temperature of the component such that the component is temperature-controlled, wherein a last one of the plurality of cascaded heat accumulators is in heat exchange with surroundings of the heat pump, and wherein an intermediate accumulator of the plurality of cascaded heat accumulators is configured to transmit heat between the cascaded heat accumulator in contact with the temperature-controlled component and the last heat accumulator such that the method comprises:

equalizing a temperature between a first heat accumulator of the plurality of cascaded heat accumulators and a first caloric accumulator element of the plurality of caloric accumulator elements by controlling a position of the first caloric accumulator element to be in thermally conducting contact with the first heat accumulator in response to the first heat accumulator deviating from a desired temperature;

changing the temperature of the first caloric accumulator element away from the desired temperature by external energy exchange between the first caloric accumulator element and an external energy source so that a temperature difference in comparison with a temperature in a second heat accumulator of the plurality of cascaded heat accumulators is increased; and moving, by the drive mechanism, the first caloric accumulator element away from its position in thermally conducting contact with the first heat accumulator into a position in thermally conducting contact with the second heat accumulator;

equalizing the temperature between the second heat accumulator and the first caloric accumulator element, wherein the first caloric accumulator element is positioned in thermally conducting contact with the second heat accumulator;

changing the temperature of the first caloric accumulator element by a reversed external energy exchange between the first caloric accumulator element and an external energy source; and moving, by the drive mechanism, the first caloric accumulator element away from its position in thermally conducting contact with the second heat accumulator into a position in thermally conducting contact with the first heat accumulator, wherein the aforementioned method operations are performed in a temporally overlapping manner, from at least one further caloric accumulator element, positioned between the second heat accumulator or the further heat accumulator, and the further heat accumulator or the last heat accumulator, and wherein the aforementioned method operations are repeated until the desired temperature is reached in the first heat accumulator.

9. The method of claim 8, further comprising:

equalizing the temperature between the relevant heat accumulator and a caloric accumulator element positioned in thermally conducting contact with the relevant heat accumulator in response to a further temperature in at least one further one of heat accumulators deviating from a desired temperature;

changing the temperature of this caloric accumulator element away from the desired temperature so that a temperature difference in comparison with the temperature in the second heat accumulator is increased by using an external energy exchange between the relevant caloric accumulator element and an external energy source, and wherein the associated drive method or mechanism, moving the relevant caloric accumulator element away from its position in thermally conducting contact with the relevant heat accumulator into a position in thermally conducting contact with another heat accumulator, wherein a reversed energy exchange and a reversed movement of the relevant caloric accumulator element is performed and the equalizing and changing are repeated until the desired temperature is reached in the relevant heat accumulator, and wherein the aforementioned method operations are performed in a temporally overlapping manner.

10. A transportation vehicle comprising at least one component to be temperature-controlled and a heat pump configured to control temperature of the at least one component to be temperature-controlled, wherein the heat pump includes a plurality of heat accumulators arranged behind one another in a cascade, a plurality of caloric accumulator elements positioned alternatingly in thermally conducting contact with, in each case, one of the plurality of heat accumulators, and at least one drive mechanism for changing a position of the each of the plurality of caloric accumulator elements between the plurality of cascaded heat accumulators, wherein at least one of the plurality of the cascaded heat accumulators is in contact with a component to control the temperature of the component such that the component is temperature-controlled, wherein a last one of the plurality of cascaded heat accumulators is in heat exchange with surroundings of the heat pump, and wherein an intermediate accumulator of the plurality of cascaded heat accumulators is configured to transmit heat between the cascaded heat accumulator in contact with the temperature-controlled component and the last heat accumulator.

11. The transportation vehicle of claim 10, wherein each of the plurality of caloric accumulator elements comprise at least one of the following materials:

a thermo-electric material from the group comprising bismuth, tellurium, and antimony;

an electro-caloric material from the group comprising a terpolymer or a lead ceramic;

an elasto-caloric material from the group comprising nickel and/or titanium formed from a nickel/titanium alloy or a nickel/titanium alloy with additional alloying elements such as copper, vanadium and cobalt; and a magneto-caloric material from the group comprising gadolinium or lanthanum.

12. The transportation vehicle of claim 10, wherein at least one of the plurality of caloric accumulator elements comprises an elasto-caloric material, and the elasto-caloric material is deformable for a temperature change of the relevant accumulator element, and wherein a drive movement is carried out by the drive mechanism together with the deformation of the elasto-caloric material in a circular or linear movement to move the caloric accumulator element between the changing positions in thermally conducting contact with the associated heat accumulators.

13. The heat pump of claim 12, wherein the elasto-caloric material of at least one of the caloric accumulator elements is subjected to both a compressive load and a tensile load by the drive movement.

14. The transportation vehicle of claim 10, wherein one dividing element is positioned between two heat accumulators of the plurality of cascaded heat accumulators to divide them fluidically, wherein one of the plurality of caloric an accumulator element is guided through an associated dividing element to change its position between the plurality of cascaded heat accumulators.

15. The transportation vehicle of claim 10, wherein at least one of the plurality of cascaded heat accumulators is a duct of a circuit line for a coolant.

16. The transportation vehicle of claim 10, wherein at least two of the plurality of cascaded heat accumulators are configured to control the temperature of, in each case, at least one temperature-controlled component.

* * * * *